US005901369A

United States Patent [19]

Pilney

[11] Patent Number: 5,901,369

[45] Date of Patent: May 11, 1999

[54] HEADGEAR HAVING AN ARTICULATED MOUNTING MECHANISM FOR A VISOR

[75] Inventor: Brian J. Pilney, St. Paul, Minn.

[73] Assignee: Honeywell Inc., Minneapolis, Minn.

[21] Appl. No.: 08/911,763

[22] Filed: Aug. 15, 1997

[51] Int. Cl.[6] ..... A42B 3/22

[52] U.S. Cl. ..... 2/6.5; 2/424; 2/422

[58] Field of Search ..... 2/410, 6.3, 6.4, 2/6.5, 6.7, 422, 424, 10, 9

[56] References Cited

U.S. PATENT DOCUMENTS

| | | | |
|---|---|---|---|
| 3,910,269 | 10/1975 | Ansite el al. . | |
| 4,023,210 | 5/1977 | Hanson . | |
| 4,170,792 | 10/1979 | Higgs . | |
| 4,223,410 | 9/1980 | Nava . | |
| 4,231,117 | 11/1980 | Aileo | 2/6.2 |
| 4,242,757 | 1/1981 | Nava . | |
| 4,247,960 | 2/1981 | Nava . | |
| 4,297,747 | 11/1981 | Nava . | |
| 4,397,047 | 8/1983 | Nava . | |
| 4,546,498 | 10/1985 | Fantin . | |
| 4,553,270 | 11/1985 | Hoffman . | |
| 4,689,836 | 9/1987 | Vitaloni . | |
| 4,718,127 | 1/1988 | Rittmann et al. . | |
| 4,916,753 | 4/1990 | Khacdung . | |
| 5,078,130 | 1/1992 | Van Oosten et al. . | |
| 5,187,502 | 2/1993 | Howell . | |
| 5,365,615 | 11/1994 | Piszkin . | |
| 5,448,780 | 9/1995 | Gath . | |
| 5,471,678 | 12/1995 | Dor . | |
| 5,506,730 | 4/1996 | Morley et al. . | |
| 5,555,570 | 9/1996 | Bay, Jr. . | |
| 5,571,217 | 11/1996 | Del Bon et al. . | |
| 5,604,930 | 2/1997 | Petit et al. . | |

*Primary Examiner*—Michael A. Neas
*Attorney, Agent, or Firm*—Albert K. Kau

[57] ABSTRACT

Disclosed is protective headgear for an aviator. The headgear includes a helmet adapted to be worn by the aviator, a visor and a mechanism for mounting the visor to the helmet. The mounting mechanism is defined by a pair of gear train assemblies, one of which is mounted to each side of the helmet adjacent to a helmet front opening. Each gear train assembly includes multiple gears that allow the visor to be manually moved between a deployed position wherein the visor covers a portion of the helmet front opening to protect the aviator's face and eyes, and a stowed position wherein the visor is completely clear of the helmet front opening so as to not obstruct the forward view of the aviator.

18 Claims, 7 Drawing Sheets

HEADGEAR HAVING AN ARTICULATED MOUNTING MECHANISM FOR A VISOR

The government has rights in this invention pursuant to Contract No. DAAJ09-95-D-0024-0002, awarded by the Department of the Army.

BACKGROUND OF THE INVENTION

This invention relates to protective headgear. In particular, the present invention is military aviator headgear comprising a helmet, a visor and a mechanism for mounting the visor to the helmet to allow controlled actuation of the visor between deployed and stowed positions.

The use of various types of protective gear for military aviators (i.e., both aircraft pilots and crew members) is well known. In particular, protective gear for the head and eyes has been used since the first open cockpit aircraft went into production. This early form of head and eyes protection took the form of a helmet and goggles. Today, military aviators, and specifically pilots, in both rotary and fixed wing aircraft, are required to wear prescribed protective headgear.

This headgear typically takes the form of a helmet having a hard outer shell formed of a synthetic composite material, such as fiberglass and an inner close fitting foamed polymer lining. The hard outer shell withstands shock loads, that may result, for example, from aircraft ejection, while the resiliency of the foamed lining evenly dissipates the forces of the shock load over a wider area. This interaction between the outer shell and liner helps to protect the helmet wearer against head injury, such as a concussion. A visor (i.e., face shield) is typically attached to the helmet so as to cover at least a portion of a helmet front opening that permits forward viewing by the wearer. The visor protects the face and eyes of the wearer and the visor is typically tinted to shield the wearer's eyes from glare or sunlight. A mounting mechanism attaches the visor to the helmet to permit raising and lowering of the visor between in use (i.e., deployed) and stowed positions.

Protective headgear comprising a helmet, and a visor which is mounted via a mechanism to permit visor movement between stowed and use positions are generally known. For example U.S. Pat. No. 4,718,127 issued to Rittman et al., U.S. Patent to Hanson and U.S. Pat. Nos. 4,397,047; 4,297,747; and 4,247,960 all issued to Nava, disclose devices for controlled lifting of visors for motorcycle helmets. However, these devices are not particularly suited for headgear to be used by military aviators because of the extremely limited range of movement of the visor between stowed and use positions. Typically, the range of motion permitted by motorcycle visor lifting devices is limited to such an extent that the visor, in the stowed position, does not clear the helmet front opening and therefore restricts the forward viewing of the helmet wearer. This arrangement is unacceptable in the military aviator environment since any obstruction within an aviator's line of sight, such as occasioned by a temporarily unneeded and stowed visor that is interfering with the aviator's forward view, may adversely affect the aviator's control of the aircraft or the aviator's ability to identify perilous circumstances.

U.S. Pat. No. 3,910,269 to Ansite et al., U.S. Pat. No. 5,187,502 to Howell and U.S. Pat. No. 5,604,930 to Petit et al. all disclose protective headgear designed for aviators. Though, the protective headgear of each of these patents incorporates a visor movably mounted to a helmet, the operation of moving the visor between in use and stowed positions presents disadvantages. For example, to move the visor between use and stowed positions, the mounting mechanism for the visor of Howell requires that a screw knob be first loosened, the visor is then moved and then the screw knob is retightened to hold the visor in its new position. Clearly this operation to move the visor of Howell is cumbersome, and may affect an aviator's ability to control an aircraft and move the visor under stressful circumstances. For visor movement, the mounting mechanism of Ansite et al. requires that an aviator perform complicated compound translational and rotational movement of the visor to move the visor between use and stowed positions. As with Howell, the operation of moving the visor of Ansite et al. is complicated and may be even dangerous in a high stress situation. Like Ansite et al., the mounting mechanism of Petit et al. also requires that the visor perform compound translational and rotational motion as the visor moves between use and stowed positions. However, unlike Ansite et al., the mounting mechanism of Petit et al. permits claimed one handed operation to achieve this visor movement. But, to achieve this single handed visor operation, the mounting mechanism of Petit et al. requires the aviator to grope for a handle on either side of the helmet to move the visor between use and stowed positions. As with Ansite et al. and Howell this could be difficult and dangerous in high stress situations.

There is a need for improved protective headgear for aviators. In particular, there is a need for headgear having an articulated mounting mechanism for a visor that allows an aviator to quickly and easily move the visor between deployed and stowed positions even in high stress aeronautical situations. In addition, the visor in its stowed position should not obstruct the aviator's line of sight or otherwise interfere with the aviator's forward view through the helmet's front opening. Lastly, the components of the headgear should be relatively easy and inexpensive to manufacture.

SUMMARY OF THE INVENTION

The present invention is headgear to be worn by a person. The headgear includes a helmet adapted for fitting upon a wearer's head, a visor and a mechanism for mounting the visor to the helmet. The helmet has a forward facing front opening that permits forward viewing by the wearer. The mounting mechanism allows the visor to be moved between a deployed position wherein the visor covers the front opening to protect the wearer's face and eyes, and a stowed position wherein the visor is completely clear of the front opening so as to not obstruct the forward view of the wearer. The mounting mechanism includes a pair of gear train assemblies. One of the gear train assemblies is mounted to each side of the helmet adjacent to the front opening. Each gear train assembly includes a first gear, a second gear adapted to mesh with said first gear, and a third gear adapted to mesh with the second gear. The first, second and third gears of the gear train assemblies cooperate to define the motion of the visor as the visor is moved between deployed and stowed positions.

The mounting mechanism of the headgear allows a wearer of the helmet to quickly and easily move the visor between deployed and stowed positions under virtually all circumstances. In addition, the visor in its stowed position does not obstruct the helmet wearer's line of sight or otherwise interfere with the wearer's forward view through the helmet's front opening. Moreover, the components of the headgear are relatively easy and inexpensive to manufacture.

DETAILED DESCRIPTION OF THE PREFERRED EMBODIMENTS

Figure 1:
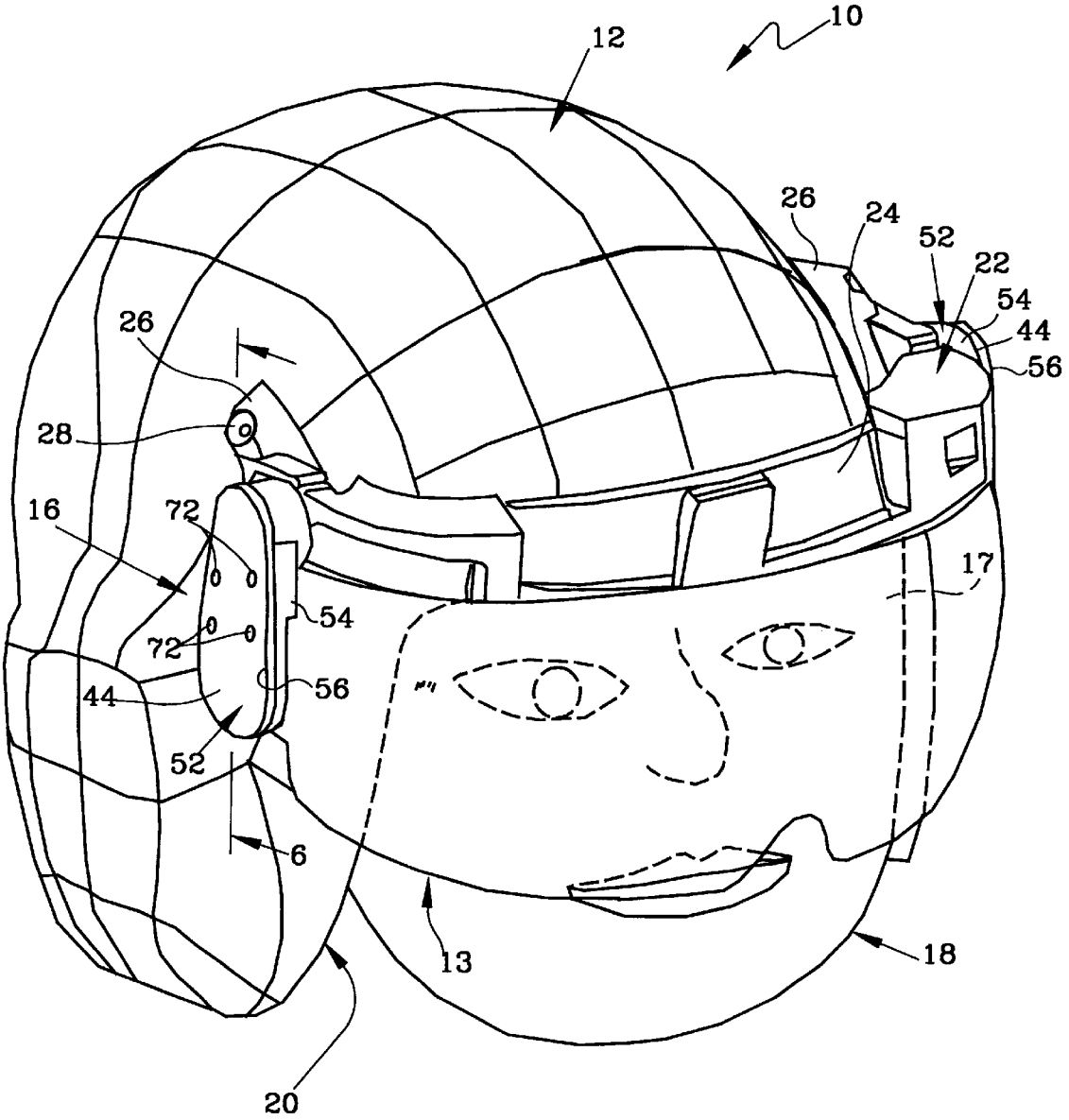
FIG. 1 is a perspective view of military aviator headgear in accordance with the present invention.
Figure 2:
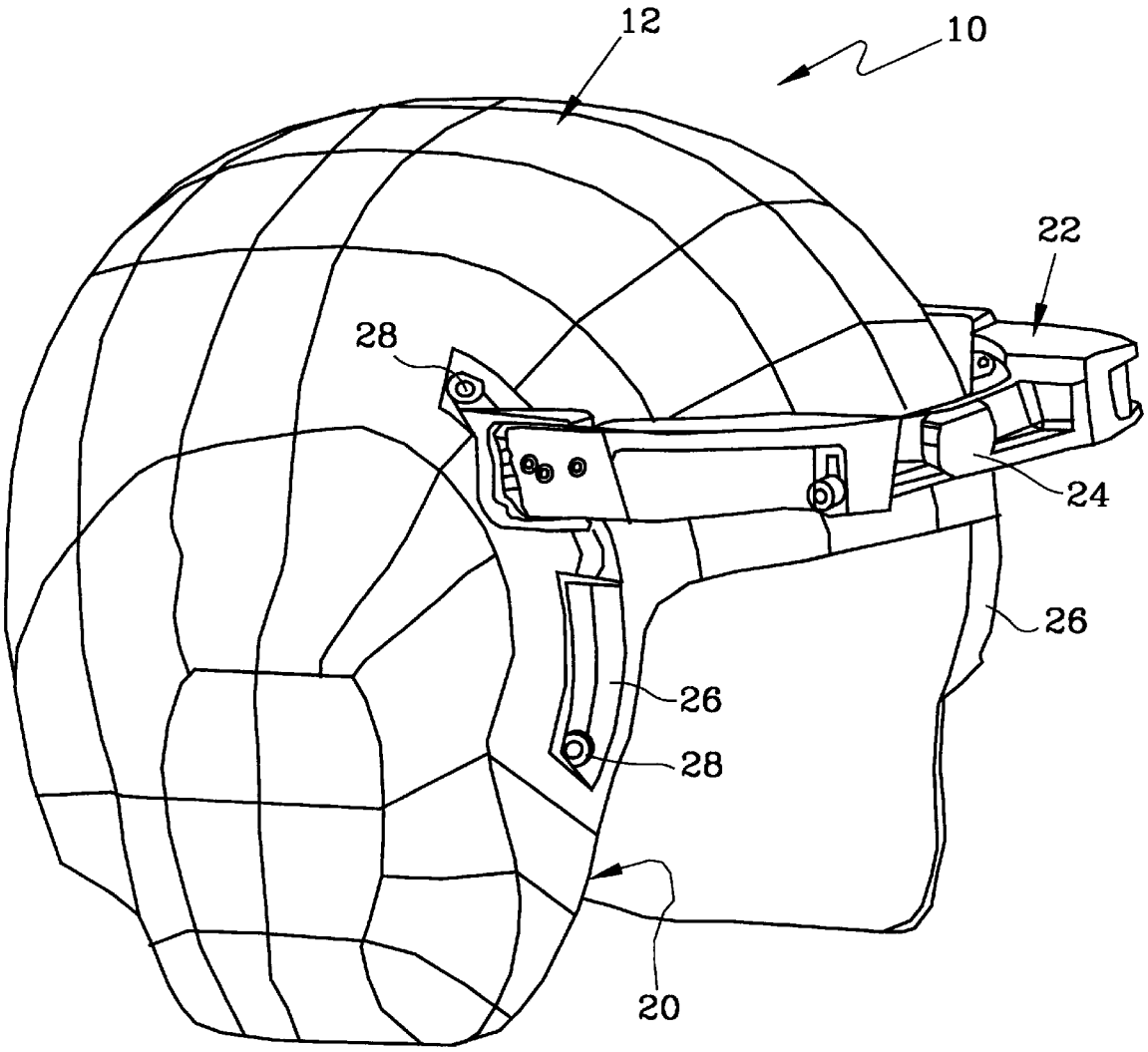
FIG. 2 is a perspective view of the military aviator headgear of FIG. 1 with the visor and articulated mounting mechanism for the visor removed for clarity.
Figure 3:
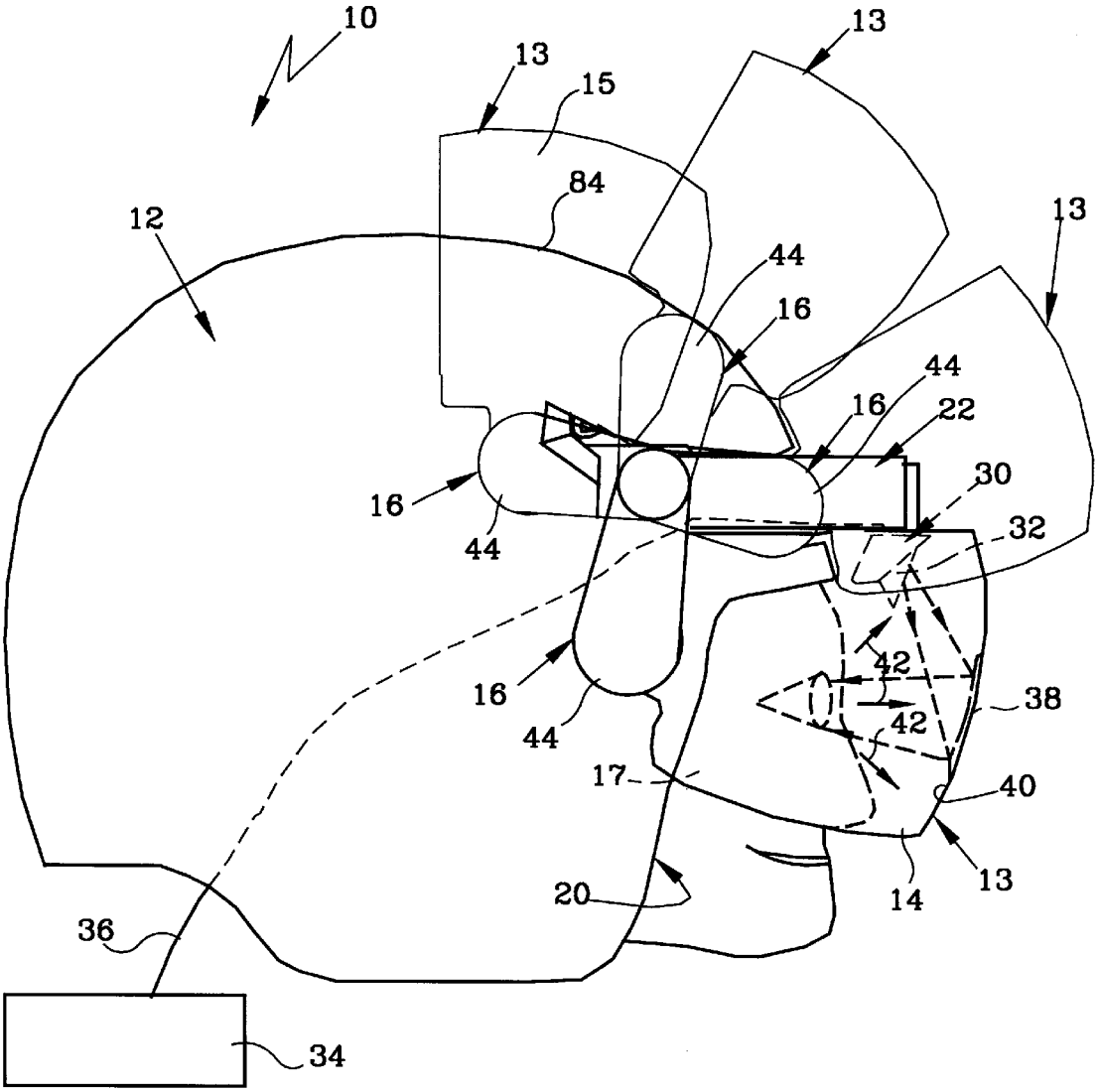
FIG. 3 is a side elevational view depicting the various orientations of the mounting mechanism and the visor relative to the helmet of the aviator headgear as the visor is moved between deployed and stowed positions.

Protective military aviator headgear 10 in accordance with the present invention is illustrated generally in FIGS. 1–3. Aviator headgear 10 includes a helmet 12, a visor 13 (movable between a deployed position 14 and a stowed position 15) and an articulated mounting mechanism 16 for attaching the visor 13 to the helmet 12. The helmet 12 is adapted for fitting upon the head 17 of a military aviator 18 (i.e., wearer) and has a forward facing front opening 20 to permit forward viewing by the aviator 18. In one preferred embodiment, the helmet 12 is constructed of a hard outer shell formed of a synthetic composite material, such as fiberglass and an inner close fitting foamed polymer lining.

As seen best in FIG. 2, the helmet 12 includes a support frame 22 defined by a cross member 24, detachably secured to a pair of mounting lugs 26 secured by threaded fasteners 28 to the sides of the helmet 12 adjacent to the front opening 20. The support frame 22 provides a mounting surface for an optical system defined by various optical elements that are necessary for the military aviator 18 to perform the tasks at hand. The optical elements may take the form of a night vision device and/or a helmet mounted display device.

As seen best in FIG. 3, in one preferred embodiment, the optical elements of the optical system is a helmet mounted display device 30 attached to the cross member 24. The display device 30 includes an image projector 32 which is coupled to an image source 34 (i.e., computer, symbol generator and/or video cameras) onboard the aircraft via a cable connection 36. The image projector 32 of the display device 30 uses a reflective zone 38 (shown only in FIG. 3) on an inner surface 40 of the visor 13 to project vital information to the eyes of the aviator 18. The information, which can take the form of piloting assistance symbols, night vision video, infrared vision video, warning symbols and/or targeting symbols, is within the forward view (represented by arrows 42) of the aviator 18 when the reflective zone 38 of the visor 13 is aligned with image projector 32 of the display device 30. As seen in FIG. 3, the position wherein the reflective zone 38 is aligned with the image projector 32, to allow viewing by the aviator 18 of the information projected by the image projector 32, is also the deployed position 14 of the visor 13. The visor 13 does not contact the display device 30 as the visor 13 is moved between the deployed position 14 and stowed position 15.

The visor 13 in the deployed position 14 covers a portion of the front opening 20 to protect the face and eyes of the aviator 18. In the stowed position 15, the visor 13 is completely clear of the front opening 20 of the helmet 12 so as not to obstruct the forward view 42 of the aviator 18. In one preferred embodiment, the visor 13 is made of a transparent plastic material, such as polycarbonate, and is tinted to protect the aviator's 18 eyes from glare and sunlight.

Figure 4:
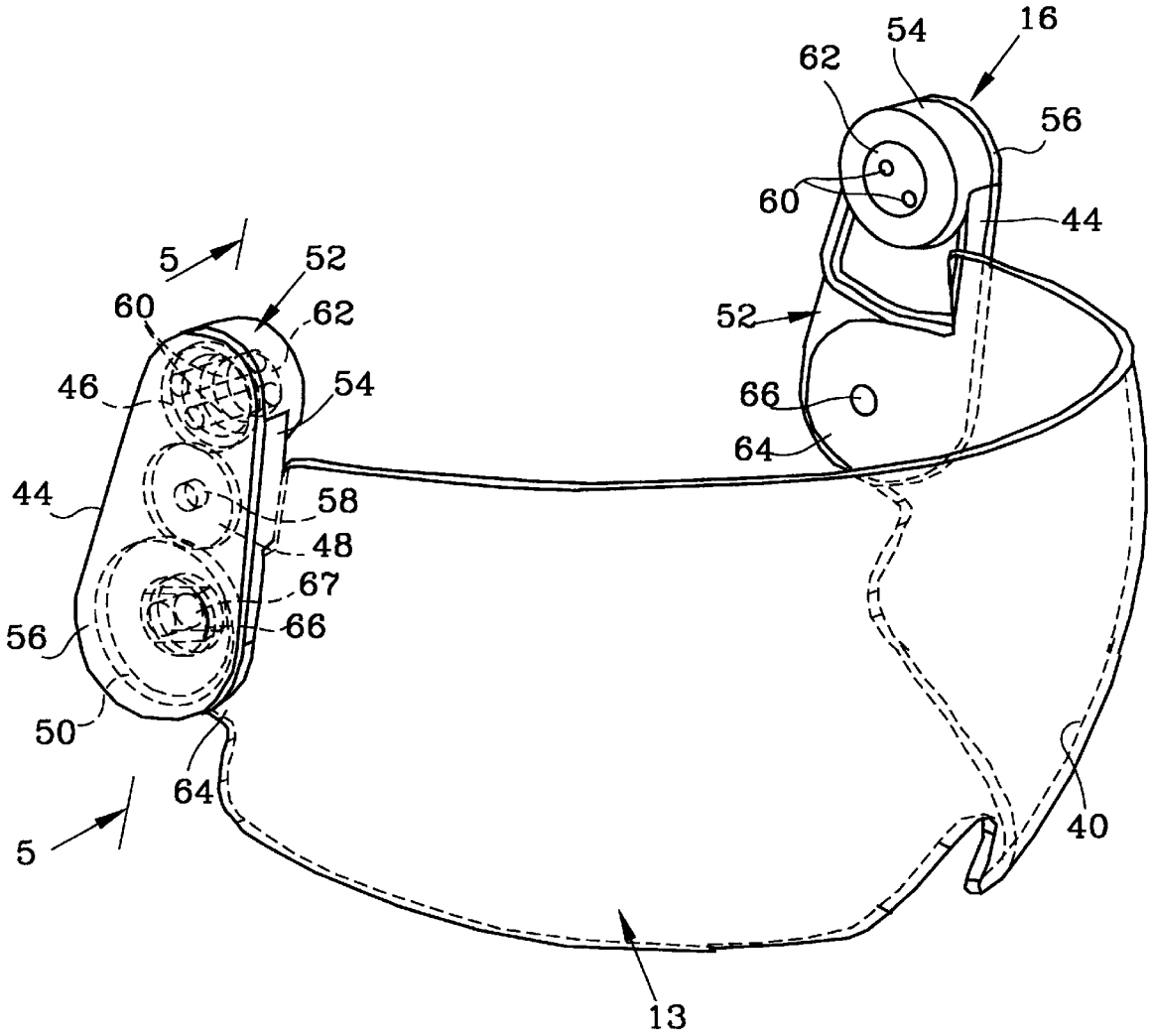
FIG. 4 is a perspective view of only the visor and articulated mounting mechanism therefor of the headgear shown in FIG. 1.

The articulated mounting mechanism 16 attaches the visor 13 to the helmet 12 so as to allow the aviator 18 to manually move, with one hand, the visor 13 between the deployed position 14 and the stowed position 15. As seen best in FIGS. 4–6, the mounting mechanism 16 includes a pair of gear train assemblies 44. One of the gear train assemblies 44 is mounted to each side of the helmet 12 adjacent to the front opening 20. The gear train assemblies 44 are identical and are mounted mirror image fashion to the visor 13 and the support frame 22 at the sides of the helmet 12. Hence, only one gear train assembly 44 will be described with particularity.

The gear train assembly 44 includes a first gear 46, a second gear 48 and a third gear 50. A housing 52 for containing the first, second and third gears 46, 48 and 50, respectively, is defined by a base member 54 and a cover member 56. As seen best in FIG. 6, the base member 54 has an integral post 58 for rotatably mounting the second gear 48 to the housing 52. The first gear 46 is immovably secured to the support frame 22 of the helmet 12 via a pair of threaded fasteners 60. The threaded fasteners 60 secure the first gear 46 to a spacer 62 and then this combination is secured the cross member 24. The spacer 62 is freely received in an aperture 64 in the base member 54. As will be made clear below, this arrangement allows the housing 54 and the second and third gears 48 and 50, respectively, to rotate about the combination first gear 46 and spacer 62. The third gear 50 is immovably secured to a tab portion 64 of the visor 13 via a threaded fastener 66. A stem portion 67 of the third gear 50 is freely received in an opening 68 in the base member 54. Notched regions 69 on the stem 67 engage cooperating notched areas 70 in the tab portion 64 to insure that the visor 13 rotates with the third gear 50.

Figure 5:
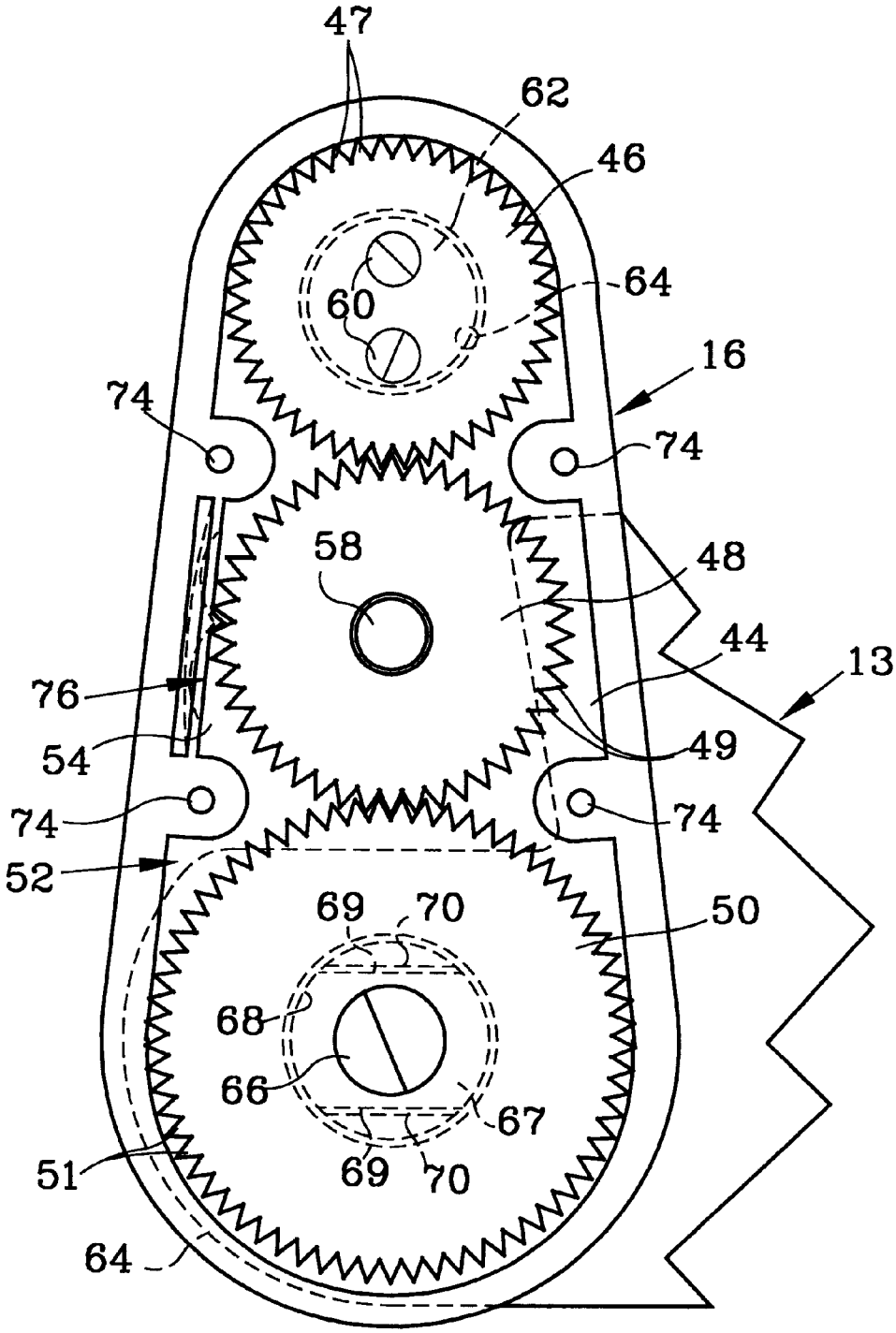
FIG. 5 is an elevational view of the articulated mounting mechanism taken along line 5—5 in FIG. 4.
Figure 6:
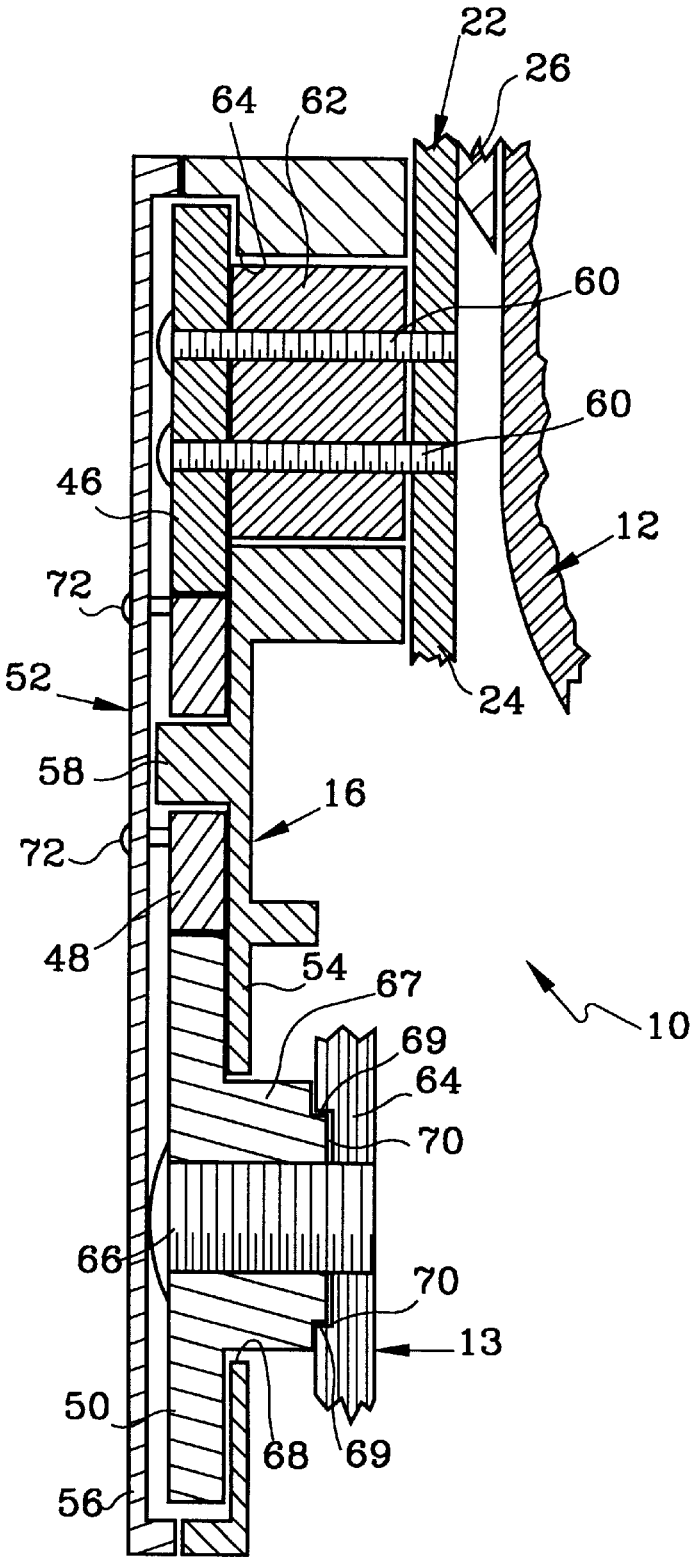
FIG. 6 is a sectional view of the articulated mounting mechanism taken along line 6—6 in FIG. 1.

As seen in FIG. 5, the first, second and third gears 46, 48 and 50, each have gear teeth 47, 49 and 51 entirely about their circumference. The gear teeth 49 of the second gear mesh with the gear teeth 47 of the first gear 46 and the gear teeth 51 of the third gear 50. The cover member 56 is secured to the base member 54 via four threaded fasteners 72 that engage threaded openings 74 in the base member 54. A latching device 76 secures the visor 13 in the deployed and stowed positions 14 and 15, respectively, and the various visor positions between these two extremes. The latching device 76 comprises a resilient latch tooth 78 on the base member 54 that engages the second gear 48 between adjacent gear teeth 49 to hold the visor 13 in a desired position. Force from the aviator 18 manually moving the visor 13 causes the gear teeth 49 to flex the resilient latch tooth 78 (see dotted line representation in FIG. 5) so that the position of the visor 13 can be easily changed.

Figure 7:
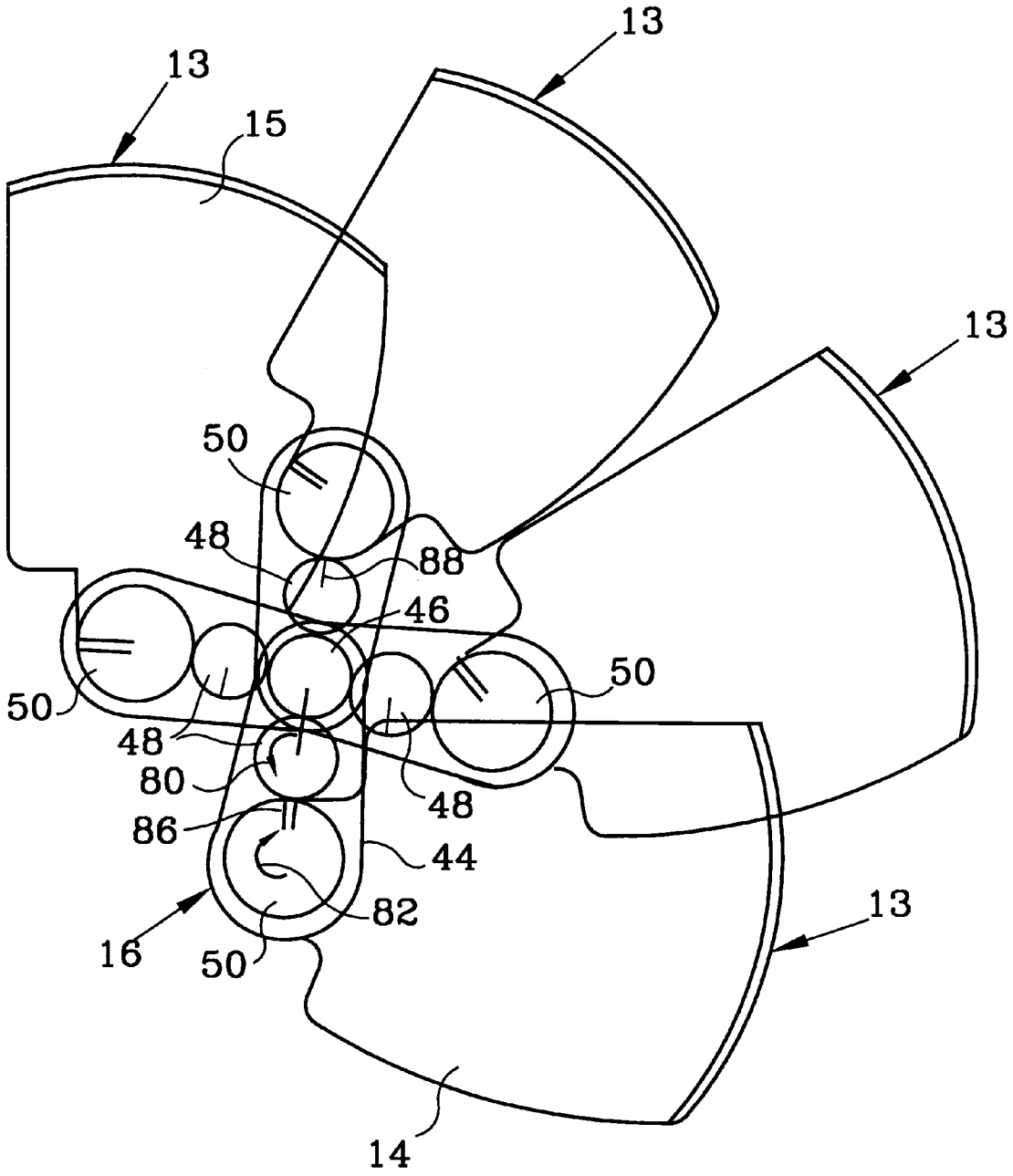
FIG. 7 is an elevational view showing details of the gear train assembly of the articulated mounting mechanism as the visor is moved between deployed and stowed positions.

In operation, as seen in FIGS. 3 and 7, the first, second and third gears 46, 48 and 50 define the motion of the visor 13 as the visor 13 is manually moved between deployed and stowed positions 14 and 15. In practice (when viewed from the right-hand side of the helmet 12), as the visor 13 is moved from the deployed position 14 to the stowed position 15, the visor 13 simultaneously rotates counter clockwise due to the housings 52 pivoting together about the first gears 46 and rotates clockwise due to the kinematic chain of the gears 46, 48 and 50 of the gear train assemblies 44. As seen best in FIG. 7, with regard to the clockwise rotation, the second gear 48 rotates counter clockwise (see arrow 80) about the first gear 46 thereby rotating the combination of the third gear 50 and visor 13 clockwise (see arrow 82).

As seen best in FIG. 3, the combination of rotation in a first direction at the first gear 46 and the opposite rotation at the third gear 50 causes the visor 13 to both pivot about the helmet 12 and to move linearly relative to an outer surface 84 of the helmet 12. In practice (when viewed from the right-hand side of the helmet 12), as the visor 13 is moved from the deployed position 14 to the stowed position 15, the visor 13 continuously pivots at a constant rate back to the outer surface 84 at the top of the helmet 12, while at the same time, the visor 13 initially moves linearly away from the helmet outer surface 84 and then subsequently moves linearly back toward the helmet outer surface 84 as the visor 13 reaches the stowed position 15. The visor 13 moves linearly away from the helmet outer surface 84 during an initial approximate 135° of movement of the housings 52, with the visor 13 moving linearly back toward the helmet outer surface 84 during the subsequent approximate 135° of movement of the housings 52. It is to be understood that the above described motion is simply reversed when the visor 13 is moved from the stowed position 15 to the deployed position 14.

As seen in FIGS. 3 and 7, the visor 13 rotates a total 90° when moved between the deployed and stowed positions 14 and 15 (see double indicator line 86). The second gear 48 of each gear train assembly 44 rotates a total of 540° (see indicator line 88) and the housings 52 rotate a total of 270° when the visor 13 is moved between the deployed and stowed positions 14 and 15. The visor 13 in the stowed position 15 maintains a low profile with respect to the helmet 12 by nesting close to the outer surface 84 at the top of the helmet 12.

Though the preferred embodiment described above illustrates a 3:1 gear ratio for the gear train assemblies 44 and a total of 90° of visor rotation (i.e., 270° total of housing rotation). It is to be understood that depending upon the desired application, the combined linear and rotational motion of the visor 13 and the total extent of movement of the visor 13 relative to the helmet 12 can both be altered by changing the gear ratio of and/or the number of gears used in the gear train assemblies 44.

The mounting mechanism 16 of the headgear 10 allows the aviator 18 to quickly and easily manually move the visor 18 between deployed and stowed positions 14 and 15 under virtually all circumstances by simply grasping any place on the visor 13 and moving the visor to the desired position. In addition, the visor 13 in its stowed position 15 does not obstruct the aviator's line of sight or otherwise interfere with the aviator's forward view 42 through the helmet's front opening 20. Moreover, the components of the headgear 10 are relatively easy and inexpensive to manufacture.

Although the present invention has been described with reference to preferred embodiments, workers skilled in the art will recognize that changes may be made in form and detail without departing from the spirit and scope of the invention.

I claim:

1. Headgear to be worn by a person, comprising:

a helmet adapted for fitting upon a wearer's head, the helmet having a forward facing front opening to permit forward viewing by a wearer;

a visor adapted to protect a wearer's face and eyes; and a mechanism for mounting the visor to the helmet such that the visor is movable between a deployed position wherein the visor covers the front opening to protect a wearer's face and eyes, and a stowed position wherein the visor is completely clear of the front opening of the helmet so as to not obstruct the forward view of a wearer, the mounting mechanism including:

a pair of gear train assemblies, one of the gear train assemblies being mounted to each side of the helmet adjacent to the front opening, each gear train assembly including:

a first gear;

a second gear adapted to mesh with the first gear;

a third gear adapted to mesh with the second gear, the first, second and third gears of the gear train assemblies cooperating to define the motion of the visor as the visor is moved between the deployed and stowed positions;

wherein each of the first, second and third gears of each gear train assembly has gear teeth entirely about its circumference to permit movement of the visor between the deployed position wherein the visor protects a wearer's face and eyes and the stowed position wherein a wearer's forward view through the helmet front opening is unobstructed; and wherein the first gear of each gear train assembly is immovably secured to the helmet and the third gear of each gear train assembly is immovably secured to the visor.

2. The headgear of claim 1 wherein each of the gear train assemblies includes a housing for at least partially containing the first, second and third gears.

3. The headgear of claim 2 wherein the second gear of each gear train assembly is rotatably mounted to the housing.

4. The headgear of claim 2 wherein the housings of the gear train assemblies pivot simultaneously about their respective first gears as the visor is moved between deployed and stowed positions.

5. The headgear of claim 4 wherein the visor moves substantially 90° when the visor is moved from the deployed position to the stowed position.

6. The headgear of claim 5 wherein the visor in the deployed position covers less than the entire helmet front opening, and wherein the visor in the stowed position maintains a low profile with respect to the helmet by nesting close to an outer surface of the helmet.

7. The headgear of claim 6 wherein the visor in the stowed position nests close to the outer surface at the top of the helmet.

8. The headgear of claim 7 wherein the mounting mechanism further includes a latching device for securing the visor in the stowed and deployed positions.

9. The headgear of claim 1 wherein the headgear is to be worn by a military aircraft aviator.

10. The headgear of claim 9 wherein the helmet includes an optical system mounted to the helmet adjacent to the helmet front opening, the visor in the deployed position permitting unobstructed use of the optical system by the aviator.

11. The headgear of claim 10 wherein the gear train assemblies cooperate so that the motion of the visor is such that the visor does not contact the optical system as the visor is moved between deployed and stowed positions.

12. The headgear of claim 11 wherein as the visor is moved between the deployed and stowed positions cooperation between the gear train assemblies cause the visor to pivot about the helmet and cause the visor to move linearly away from and towards an outer surface of the helmet.

13. The headgear of claim 12 wherein as the visor is moved from the deployed position to the stowed position the visor continuously pivots at a constant rate back to the outer surface at the top of the helmet, while at the same time, the visor initially moves linearly away from the helmet outer surface and then subsequently moves linearly toward the helmet outer surface as the visor reaches the stowed position.

14. The headgear of claim 13 wherein the visor moves linearly away from the helmet outer surface during the initial 135° of movement of the gear train assemblies, and the visor moves linearly toward the helmet outer surface during the subsequent 135° of movement of the gear train assemblies.

15. The headgear of claim 11 wherein the optical system includes a night vision system.

16. The headgear of claim 11 wherein an inner surface of the visor has a semi-reflective zone, and the optical system includes a display system for displaying information vital to the aviator within the forward view of the aviator on the semi-reflective zone of the visor when the semi-reflective zone is aligned with the display system.

17. The headgear of claim 16 wherein the mounting mechanism further includes a latching device for securing the visor in a display system viewing position with the semi-reflective zone of the visor aligned with the display system.

18. The headgear of claim 17 wherein the display system viewing position is also the deployed position of the visor, and the latching device further secures the visor in the stowed position.

* * * * *